US005510049A

United States Patent [19]

Connor et al.

[11] Patent Number: 5,510,049

[45] **Date of Patent: * Apr. 23, 1996**

[54] BAR COMPOSITION WITH N-ALKOXY OR N-ARYLOXY POLYHYDROXY FATTY ACID AMIDE SURFACTANT

[75] Inventors: Daniel S. Connor, Cincinnati; Yi-Chang Fu, Wyoming; Jeffrey J. Scheibel, Cincinnati, all of Ohio

[73] Assignee: The Procter & Gamble Company, Cininnati, Ohio

[ * ] Notice: The portion of the term of this patent subsequent to Jul. 26, 2014, has been disclaimed.

[21] Appl. No.: 278,853

[22] Filed: Jul. 26, 1994

Related U.S. Application Data

[63] Continuation-in-part of Ser. No. 118,918, Sep. 9, 1993, abandoned.

[51] Int. Cl.[6] ..... C11D 1/18; C11D 1/12; C11D 1/75; C11D 9/32

[52] U.S. Cl. ..... 252/108; 252/117; 252/121; 252/134; 252/174.17; 252/523; 252/525; 252/529; 252/550; 252/554; 252/558

[58] Field of Search ..... 252/108, 117, 252/121, 558, 554, 550, 523, 525, 529, 174.17, 134

[56] References Cited

U.S. PATENT DOCUMENTS

| | | | |
|---|---|---|---|
| 3,607,761 | 9/1971 | Feighner et al. | 252/108 |
| 3,654,166 | 4/1972 | Eckert & Heins | 252/117 |
| 3,793,214 | 2/1974 | O'Neill et al. | 252/117 |
| 3,916,003 | 10/1975 | Suzuki et al. | 260/404 |
| 5,174,927 | 12/1992 | Honsa | 252/543 |
| 5,244,593 | 9/1993 | Roselle et al. | 252/99 |
| 5,254,281 | 10/1993 | Pichardo et al. | 252/108 |
| 5,283,009 | 2/1994 | Speckman et al. | 252/548 |
| 5,332,528 | 7/1994 | Pan et al. | 252/548 |

OTHER PUBLICATIONS

PCT Search Report dated Nov. 11, 1994.

*Primary Examiner*—E. Rollins Cross
*Assistant Examiner*—Patricia C. Hailey
*Attorney, Agent, or Firm*—Jerry J. Yetter; Jacobus C. Rasser

[57] ABSTRACT

Laundry or toilet bars comprising one or more surface active agents such as soaps or synthetic detergents are prepared using an alkoxy or aryloxy polyhydroxy fatty acid amide to improve bar smear, cracking or wearing qualities, Palm oil chain-length fatty acid amides of N-(3-methoxypropyl) glucamine and N-(2-methoxyethyl) glucamine are examples of the glucamide surfactant used in such bars.

7 Claims, No Drawings

BAR COMPOSITION WITH N-ALKOXY OR N-ARYLOXY POLYHYDROXY FATTY ACID AMIDE SURFACTANT

This is a continuation-in-part of application Ser. No. 08/118,918, filed on Sep. 9, 1993, now abandoned.

FIELD OF THE INVENTION

The present invention relates to toilet bar and laundry bar compositions with high cleaning properties and superior bar characteristics.

BACKGROUND OF THE INVENTION

The formulator of laundry bar and personal cleansing bar compositions is faced with several known problems. Such bars can form various types of gels, especially when stored in-use under circumstances where they can be contacted by water. The bar then softens and smears. Besides being unsightly, this can lead to product wastage. One method of decreasing bar smear is by lowering the water content of the bar. However, bars with reduced water content bars tend to crack on storage. Accordingly, there is a continuing search for new ways to provide improved laundry and personal care bar compositions.

Considerable success in the formulation of soap bars has recently been achieved using the N-alkyl polyhydroxy fatty acid amide surfactants. However, even these superior surfactants do suffer from some drawbacks. For example, their solubility is not as high as might be desired for optimal formulations. At high concentrations in water they can be difficult to handle and pump, so additives must be employed in manufacturing plants to control their viscosity. While quite compatible with anionic surfactants, overall product compatibility can be diminished substantially in the presence of water hardness cations. In addition, there is always the objective to find new surfactants which lower interfacial tensions to an even greater degree than the N-alkyl polyhydroxy fatty acid amides in order to increase cleaning performance.

It has now been determined that the N-alkoxy and N-aryloxy polyhydroxy fatty acid amide surfactants surprisingly differ from their counterpart N-alkyl polyhydroxy fatty acid amide surfactants in several important and unexpected ways which are of considerable benefit to detergent formulators. The alkoxy and aryloxy-substituted polyhydroxy fatty acid amide surfactants herein substantially reduce interfacial tensions, and thus provide for high cleaning performance in detergent compositions, even at low wash temperatures. The surfactants herein are quite compatible with conventional carboxylate soaps as well as with anionic surfactants such as the alkyl benzene sulfates and alkyl sulfates, even in the presence of water hardness cations such as calcium and magnesium ions. This means that the bar compositions herein can be more effective even under the so-called "underbuilt" situation that occurs with many nonphosphate builders. The surfactants herein exhibit enhanced dissolution in water as compared with the corresponding N-alkyl polyhydroxy fatty acid amide surfactants, even at low temperatures (5°–40° C.). The high solubility of the surfactants herein allows them to be formulated as concentrated bars. Moreover, the surfactants herein can be easily prepared as low viscosity, pumpable solutions at concentrations (or melts) as high as 70–100%, which allows them to be easily handled in the manufacturing plant. The surfactants herein also have the advantage of providing a lower sudsing profile than the N-methyl polyhydroxy fatty acid amides, which desirably decreases the carry-over of suds into the rinse bath.

Moreover, the present surfactants, used in combination with conventional anionic surfactants or with conventional soap, provide bar compositions with low smear, appropriate bar hardness with associated decreased wastage, and low tendency to crack on storage.

BACKGROUND ART

Japanese Kokai HEI 3[1991]-246265 Osamu Tachizawa, U.S. Pat. Nos. 5,194,639, 5,174,927 and 5,188,769 and WO 9,206,171, 9,206,151, 9,206,150 and 9,205,764 relate to various polyhydroxy fatty acid amide surfactants and uses thereof.

SUMMARY OF THE INVENTION

The present invention encompasses a laundry or toilet bar, or the like, comprising one or more surface-active agents, typically at levels from about 20% to about 99%, by weight, selected from the group consisting of synthetic anionic surfactants and soaps, said bars containing at least about 1% by weight of an alkoxy or aryloxy polyhydroxy fatty acid amide of the formula

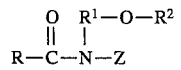

wherein R is $C_7$ to $C_{21}$ hydrocarbyl moiety, $R^1$ is $C_2$ to $C_8$ hydrocarbyl moiety moiety, $R^2$ is $C_1$–$C_8$ hydrocarbyl moiety or oxyhydrocarbyl moiety and Z is a polyhydroxy hydrocarbyl moiety having a linear chain with at least 2 hydroxyls directly connected to the chain, or an alkoxylated derivative thereof. Preferred bars herein are those wherein R is $C_{11}$–$C_{17}$ hydrocarbyl, $R^1$ is $C_2$–$C_4$ alkylene, especially —$CH_2CH_2$— (for higher sudsing bars) or —$CH_2CH_2CH_2$— (for lower sudsing bars), and $R^2$ is $C_1$–$C_4$ alkyl, especially methyl. Optimal cleaning is secured when R is $C_{15}$–$C_{17}$ or mixed "palm fraction" fatty acids.

Toilet bars for personal cleansing or bars for fabric laundering include those wherein the surface-active agent is a $C_{10}$–$C_{18}$ fatty acid soap, and preferably contain at least about 3%, typically 3% to about 20%, by weight of said N-alkoxy polyhydroxy fatty acid amide.

Personal cleansing and laundry bars also include those wherein the surface-active agent is a $C_{10}$–$C_{18}$ sulfated or sulfonated anionic surfactant, and preferably contain at least about 3%, typically 3% to about 20%, by weight of said N-alkoxy polyhydroxy fatty acid amide. Laundry bars herein will typically also contain various detergent adjuncts such as builders, enzymes, bleaches, and the like.

The present invention also encompasses a process for manufacturing bar compositions with the aforesaid improved properties by adding at least about 3% by weight of said N-alkoxy or N-aryloxy polyhydroxy fatty acid amide surfactants thereto.

All percentages, ratios and proportions herein are by weight, unless otherwise specified. All documents cited herein are incorporated by reference.

DETAILED DESCRIPTION OF THE INVENTION

The N-alkoxy and N-aryloxy polyhydroxy fatty acid amide surfactants used in the practice of this invention are quite different from traditional ethoxylated nonionics, due to the use of a linear polyhydroxy chain as the hydrophilic group instead of the ethoxylation chain. Conventional ethoxylated nonionic surfactants have cloud points with the less hydrophilic ether linkages. They become less soluble, more surface active and better performing as temperature increases, due to thermally induced randomness of the ethoxylation chain. When the temperature gets lower, ethoxylated nonionics become more soluble by forming micelles at very low concentration and are less surface active, and lower performing, especially when washing time is short.

In contrast, the polyhydroxy fatty acid amide surfactants have polyhydroxyl groups which are strongly hydrated and do not exhibit cloud point behavior. It has been discovered that they exhibit Krafft point behavior with increasing temperature and thus higher solubility at elevated temperatures. They also have critical micelle concentrations similar to anionic surfactants, and it has been surprisingly discovered that they clean like anionics.

Moreover, the polyhydroxy fatty acid amides herein are different from the alkyl polyglycosides (APG) which comprise another class of polyhydroxyl nonionic surfactants. While not intending to be limited by theory, it is believed that the difference is in the linear polyhydroxyl chain of the polyhydroxy fatty acid amides vs. the cyclic APG chain which prevents close packing at interfaces for effective cleaning.

With respect to the N-alkoxy and N-aryloxy polyhydroxy fatty acid amides, such surfactants have now been found to have a much wider temperature usage profile than their N-alkyl counterparts, and they require no or little cosurfactants for solubility at temperatures as low as 5° C. Such surfactants also provide easier processing due to their lower melting points. It has now further been discovered that these surfactants are biodegradable.

As is well-known to formulators, most laundry detergents are formulated with mainly anionic surfactants, with nonionics sometimes being used for grease/oil removal. Since it is well known that nonionic surfactants are far better for enzymes, polymers, soil suspension and skin mildness, it would be preferred that laundry detergents use more nonionic surfactants. Unfortunately, traditional nonionics do not clean well enough in cooler water with short washing times.

It has now also been discovered that the N-alkoxy and N-aryloxy polyhydroxy fatty acid amide surfactants herein provide additional benefits over conventional nonionics, as follows:

a. Much enhanced stability and effectiveness of new enzymes, like cellulase and lipase, and improved performance of soil release polymers;

b. Much less dye bleeding from colored fabrics, with less dye transfer onto whites;

c. Better water hardness tolerance;

d. Better greasy soil suspension with less redeposition onto fabrics; and e. The ability to incorporate higher levels of the polyhydroxy amide surfactants into bars.

The N-alkoxy and N-aryloxy polyhydroxy fatty acid nonionic surfactants used herein comprise amides of the formula:

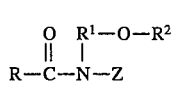

wherein: R is $C_7$–$C_{21}$ hydrocarbyl, preferably $C_9$–$C_{17}$ hydrocarbyl, including straight-chain (preferred), branched-chain alkyl and alkenyl, as well as substituted alkyl and alkenyl, e.g., 12-hydroxyoleic, or mixtures thereof; $R^1$ is $C_2$–$C_8$ hydrocarbyl including straight-chain, branched-chain and cyclic (including aryl), and is preferably $C_2$–$C_4$ alkylene, i.e., —$CH_2CH_2$—, —$CH_2CH_2CH_2$— and —$CH_2(CH_2)_2CH_2$—; and $R^2$ is $C_1$–$C_8$ straight-chain, branched-chain or cyclic hydrocarbyl including aryl and oxy-hydrocarbyl, and is preferably $C_1$–$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, where n is an integer from 1 to 5, inclusive, and R' is H or a cyclic mono- or polysaccharide, and alkoxylated derivatives thereof. Most preferred are glycityls wherein n is 4, particularly —$CH_2$—$(CHOH)_4$—$CH_2OH$.

In compounds of the above formula, nonlimiting examples of the amine substituent group —$R^1$—O—$R^2$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranyloxyethyl-, 3-[2-methoxyethoxy]propyl-, 2-[2-methoxyethoxy]ethyl-, 3-[3-methoxypropoxy]propyl-, 2-[3-methoxypropoxy]ethyl-, 3-[methoxypolyethyleneoxy]-propyl-, 3-[4-methoxybutoxy]propyl-, 3-[2-methoxyisopropoxy]propyl-, $CH_3OCH_2CH(CH_3)$— and $CH_3OCH_2CH(CH_3)CH_2$-O-$(CH_2)_3$-.

R—CO—N< can be, for example, cocamide, stearamide, oleamide, lauramide, myristamide, capricamide, palmitamide, tallowamide, ricinolamide, etc.

While the synthesis of N-alkoxy or N-aryloxy polyhydroxy fatty acid amides can prospectively be conducted using various processes, contamination with cyclized by-products and other colored materials may be problematic. As an overall proposition, the synthesis method for these surfactants comprises reacting the appropriate N-alkoxy or N-aryloxy-substituted aminopolyols with, preferably, fatty acid methyl esters with or without a solvent using an alkoxide catalyst (e.g., sodium methoxide or the sodium salts of glycerin or propylene glycol) at temperatures of about 85° C. to provide products having desirable low levels (preferably, less than about 10%) of ester amide or cyclized by-products and also with improved color and improved color stability, e.g., Gardner Colors below about 4, preferably between 0 and 2. If desired, any unreacted N-alkoxy or N-aryloxy amino polyol remaining in the product can be acylated with an acid anhydride, e.g., acetic anhydride, maleic anhydride, or the like, in water at 50° C.–85° C., to minimize the overall level of such residual amines in the product. Residual sources of straight-chain primary fatty acids, which can suppress suds, can be depleted by reaction with, for example, monoethanolamine at 50° C.–85° C.

If desired, the water solubility of the solid N-alkoxy polyhydroxy fatty acid amide surfactants herein can be enhanced by quick cooling from a melt. While not intending to be limited by theory, it appears that such quick cooling re-solidifies the melt into a metastable solid which is more soluble in water than the pure crystalline form of the N-alkoxy polyhydroxy fatty acid amide. Such quick cooling can be accomplished by any convenient means, such as by use of chilled (0° C.–10° C.) rollers, by casting the melt onto a chilled surface such as a chilled steel plate, by means of refrigerant coils immersed in the melt, or the like.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

The following illustrates the syntheses in more detail.

EXAMPLE I

Preparation of N-(2-methoxyethyl)glucamine

N-(2-methoxyethyl)glucosylamine (sugar adduct) is prepared starting with 1728.26 g of 50 wt. % 2-methoxyethylamine in water (11.5 moles, 1.1 mole equivalent of 2-methoxyethylamine) placed under an $N_2$ blanket at 10° C. 2768.57 grams of 50 wt. % glucose in water (10.46 moles, 1 mole equivalent of glucose), which is degassed with $N_2$, is added slowly, with mixing, to the methoxyethylamine solution keeping the temperature below 10° C. The solution is mixed for about 40 minutes after glucose addition is complete. It can be used immediately or stored 0° C.–5° C. for several days.

About 278 g (~15 wt. % based on amount of glucose used) of Raney Ni (Activated Metals & Chemicals, Inc. product A-5000 or A-5200) is loaded into a 2 gallon reactor (3 16 stainless steel baffled autoclave with DISPERSIMAX hollow shaft multi-blade impeller) with 4 L of water. The reactor is heated, with stirring, to 130° C. at about 1500 psig hydrogen for 30 minutes. The reactor is then cooled to room temperature and the water removed to 10% of the reactor volume under hydrogen pressure using an internal dip tube.

The reactor is vented and the sugar adduct is loaded into the reactor at ambient hydrogen pressure. The reactor is then purged twice with hydrogen. Stirring is begun, the reactor is heated to 50° C., pressurized to about 1200 psig hydrogen and these conditions are held for about 2 hours. The temperature is then raised to 60° C. for 10 minutes, 70° C. for 5 minutes, 80° C. for 5 minutes, 90° C. for 10 minutes, and finally 100° C. for 25 minutes.

The reactor is then cooled to 50° C. and the reaction solution is removed from the reactor under hydrogen pressure via an internal dip tube and through a filter in closed communication with the reactor. Filtering product under hydrogen pressure allows removal of any nickel particles without nickel dissolution.

Solid N-(2-methoxyethyl)glucamine is recovered by evaporation of water and excess 2-methoxyethylamine. The product purity is approximately 90% by G.C. Sorbitol is the major impurity at about 10%. The N-(2-methoxyethyl)glucamine can be used as is or purified to greater than 99% by recrystallization from methanol.

EXAMPLE II

Preparation of $C_{12}$-N-(2-Methoxyethyl)glucamide

N-(2-methoxyethyl)glucamine, 1195 g (5.0 mole; prepared according to Example I) is melted at 135° C. under nitrogen. A vacuum is pulled to 30 inches (762 ram) Hg for 15 minutes to remove gases and moisture. Propylene glycol, 21.1 g (0.28 mole) and fatty acid methyl ester (Procter & Gamble CE 1295 methyl ester) 1097 (5.1 mole) are added to the preheated amine. Immediately following, 25% sodium methoxide, 54 g (0.25 mole) is added in halves.

Reactants weight: 2367.1 g

Theoretical MeOH generated: (5.0×32)+(0.75×54)+(0.24×32)=208.5 g

Theory product: FW 422 2110 g 5.0 mole

The reaction mixture is homogeneous within 2 minutes of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 10 inches (254 mm) Hg. At 180 minutes, another GC sample is taken and the vacuum has been increased to 16 inches (406 mm) Hg. After 180 minutes at 85° C., the remaining weight of methanol in the reaction is 4.1% based on the following calculation: 2251 g current reaction wt.—(2367.1 g reactants wt.—208.5 g theoretical MeOH)/2251 g=4.1% MeOH remaining in the reaction. After 180 minutes, the reaction is bottled and allowed to solidify at least overnight to yield the desired product.

EXAMPLE Ill

Preparation of N-(3-methoxypropyl)glucamine

About 300 g (about 15 wt. % based on amount of glucose used) of Raney Ni (Activated Metals & Chemicals, Inc. product A-5000) is contained in a 2 gallon reactor (316 stainless steel baffled autoclave with DISPERSIMAX hollow shaft multi-blade impeller) pressurized to about 300 psig with hydrogen at room temperature. The nickel bed is covered with water taking up about 10% of the reactor volume.

1764.8 g (19.8 moles, 1.78 mole equivalent) of 3-methoxypropylamine (99%) is maintained in a separate reservoir which is in closed communication with the reactor. The reservoir is pressurized to about 100 psig with nitrogen. 4000 g of 50 wt. % glucose in water (11.1 moles, I mole equivalent of glucose) is maintained in a second separate reservoir which is also in closed communication with the reactor and is also pressurized to about 100 psig with nitrogen.

The 3-methoxypropylamine is loaded into the reactor from the reservoir using a high pressure pump. Once all the 3-methoxypropylamine is loaded into the reactor, stirring is begun and the reactor heated to 60° C. and pressurized to about 800 psig hydrogen. The reactor is stirred at 60° C. and about 800 psig hydrogen for about 1 hour.

The glucose solution is then loaded into the reactor from the reservoir using a high pressure pump similar to the amine pump above. However, the pumping rate on the glucose pump can be varied and on this particular run, it is set to load the glucose in about 1 hour. Once all the glucose has been loaded into the reactor, the pressure is boosted to about 1500 psig hydrogen and the temperature maintained at 60° C. for about 1 hour. The temperature is then raised to 70° C. for 10 minutes, 80° C. for 5 minutes, 90° C. for 5 minutes, and finally 100° C. for 15 minutes.

The reactor is then cooled to 60° C. and the reaction solution is removed from the reactor under hydrogen pressure via an internal dip tube and through a filter in closed communication with the reactor. Filtering under hydrogen pressure allows removal of any nickel particles without nickel dissolution.

Solid N-(3-methoxypropyl)glucamine is recovered by evaporation of water and excess 3-methoxypropylamine. The product purity is approximately 90% by G.C. Sorbitol is the major impurity at about 3%. The N-(3-methoxypropyl)glucamine can be used as is or purified to greater than 99% by recrystallization from methanol.

EXAMPLE IV

Preparation of $C_{12}$-N-(3-Methoxypropyl)glucamide

N-(3-methoxypropyl)glucamine, 1265 g (5.0 mole prepared according to Example III) is melted at 140° C. under nitrogen. A vacuum is pulled to 25 inches (635 mm) Hg for 10 minutes to remove gases and moisture. Propylene glycol, 109 g (1.43 mole) and CE 1295 methyl ester, 1097 (5.1 mole) are added to the preheated amine. Immediately following, 25% sodium methoxide, 54 g (0.25 mole) is added in halves.

Reactants weight: 2525 g

Theoretical MeOH generated: (5.0×32)+(0.75×54)+(0.24×32)=208.5 g

Theory product: FW 436 2180 g 5.0 mole

The reaction mixture is homogeneous within 1 minute of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 12 inches (305 mm) Hg. At 180 minutes, another GC sample is taken and the vacuum has been increased to 20 inches (508 ram) Hg. After 180 minutes at 85° C., the remaining weight of methanol in the reaction is 2.9% based on the following calculation: 2386 g current reaction wt.—( 2525 g reactants wt.—208.5 g theoretical MeOH)/2386 g=2.9% MeOH remaining in the reaction. After 180 minutes, the reaction is bottled and allowed to solidify at least overnight to yield the desired product.

EXAMPLE V $C_{18}$Methoxypropyl Glucamide-N-(3-methoxypropyl)glucamine, 40 g (0.158 mole) is melted at 145° C. under nitrogen. A vacuum is applied to 38.1 cm (15 inches) Hg for 5 minutes to remove gases and moisture. Separately, methylstearate, 47.19 g (0.158 mole) is preheated to 130° C. and added to the melted amine with rapid stirring along with 9.0 grams of propylene glycol (10 weight % based on reactants). Immediately following, 25% sodium methoxide, 1.7 g (0.0079 mole) is added.

The reaction mixture is homogeneous within 2 minutes of adding the catalyst at 130° C. It is allowed to reflux in order to cool to 85°–90° C. in a 250 ml, 3 neck round bottom flask equipped with a hot oil bath, TRUBORE stirrer with TEFLON paddle, gas inlet and outlet, THERMOWATCH, condenser, and stirrer motor. The reaction requires about 35 minutes to reach 90° C. After 3 hours at 85°–90° C. a vacuum is applied to remove methanol. The reaction mixture is poured out into a jar after a total of 4 hours. The solid reaction product is recrystallized from 400 mls of acetone and 20 mls of methanol. The filter cake is washed twice with 100 ml portions of acetone and is dried in a vacuum oven. A second recrystallization is performed on 51.91 grams of the product of the first recrystallization using 500 mls acetone and 50 mls methanol to give after filtration, washing with two 100 ml portions of acetone and drying in a vacuum oven a yield of 47.7 grams of the N-octadecanoyl-N-(3-methoxypropyl)glucamide. Melting point of the sample is 89° C. If desired, the product can be further purified using an acetone/methanol solvent.

EXAMPLE VI $C_{16}$Methoxypropyl Glucamide - The reaction of Example V is repeated using an equivalent amount of methyl palmitate to replace the methyl stearate. The resulting hexadecanoyl-N-(3-methoxypropyl)glucamine has a melting point of 84° C. If desired, the product can be further purified using an acetone/methanol solvent.

EXAMPLE VII

Mixed Palm Fatty Acid Methoxypropyl Glucamide N - methoxypropylglucamine, 1265 g (5.0 mole) is melted at 145° C. under nitrogen. A vacuum is applied to 38.1 cm (15 inches) Hg for 10 minutes to remove gases and moisture. Separately, hardened palm stearine methyl ester, 1375 g (5.0 mole) is preheated to 130° C. and added to the melted amine with rapid stirring. Immediately following, 25% sodium methoxide, 54 g (0.25 mole) is added through a dropping funnel. Half the catalyst is added before the reaction is homogeneous to control the hard reflux of methanol. After homogeneity is reached, the other half of the catalyst is added within 10 minutes.

Reactants weight: 2694 g

Theoretical MeOH generated: (5.0×32)+(0.75×54)+(0.25×32)=208.5 g MeOH

Theory product: FW 496 2480 g 5.0 mole

The reaction mixture is homogeneous within 5 minutes of adding the first half of the catalyst at 132° C. It is allowed to reflux in order to cool to 90°–95° C. in a 5 liter, 4 neck round bottom flask equipped with a heating mantle, TRUBORE stirrer with TEFLON paddle, gas inlet and outlet, THERMOWATCH, condenser, and air drive motor. When the first half of the catalyst is added, time=0. At 40 minutes, a vacuum of 25.4 cm (10 inches) Hg is applied to remove methanol. At 48 minutes, vacuum is increased to 43.2 cm (17 inches) Hg. At 65 minutes, the remaining weight of methanol in the reaction is 2.9% based on the following calculation:

2559 g current reaction wt—(2694 g reactants wt—208.5 g theoretical MeOH)/2559 g =2.9% MeOH remaining in the reaction.

By 120 minutes, the vacuum has been increased to 50.8 cm (20 inches) Hg. At 180 minutes, the vacuum has been increased to 58.4 cm (23 inches) Hg and the reaction is poured into a stainless pan and allowed to solidify at room temperature. Also, the remaining weight of methanol is calculated to be 1.3%. After sitting for 4 days, it is hand ground for use.

In an economical process, fatty glyceride esters can also be used in the foregoing process. Natural plant oils such as palm, palm kernel oil, soy and canola, as well as tallow are typical sources for such materials. Thus, for example, in an alternate mode, the above process is conducted using palm kernel oil to provide the desired mixture of N-alkoxyglucamine surfactants.

In the general manner of Example IV (with methanol solvent) or V, oleoyl-N-(3-methoxypropyl)glucamine is prepared by reacting 49.98 grams of N-(3-methoxypropyl)glucamine with 61.43 g of methyl oleate in the presence of 4.26 g of 25 wt % $NaOCH_3$. The oleoyl derivative of N-(2-methoxyethyl) glucamine is prepared in like manner. The corresponding surfactants made from palm kernel oil fatty acids can be prepared in like manner.

Glyceride Process

If desired, the N-alkoxy and N-aryloxy surfactants used herein may be made directly from natural fats and oils rather than fatty acid methyl esters. This so-called "glyceride process" results in a product which is substantially free of conventional fatty acids such as lauric, myristic and the like, which are capable of precipitating as calcium soaps under wash conditions, thus resulting in unwanted residues on fabrics or filming/spotting in, for example, hard surface cleaners and dishware cleaners.

Triglyceride Reactant - The reactant used in the glyceride process can be any of the well-known fats and oils, such as those conventionally used as foodstuffs or as fatty acid sources. Non-limiting examples include: CRISCO oil; palm oil; palm kernel oil; corn oil; cottonseed oil; soybean oil; tallow; lard; canola oil; rapeseed oil; peanut oil; tung oil; olive oil; menhaden oil; coconut oil; castor oil; sunflower seed oil; and the corresponding "hardened", i.e., hydrogenated oils. If desired, low molecular weight or volatile materials can be removed from the oils by steam-stripping, vacuum stripping, treatment with carbon or "bleaching earths" (diatomaceous earth), or cold tempering to further minimize the presence of malodorous by-products in the surfactants prepared by the glyceride process.

N-substituted Polyhydroxy Amine - The N-alkyl, N-alkoxy or N-aryloxy polyhydroxy amines used in the process are commercially available, or can be prepared by reacting the corresponding N-substituted amine with a reducing sugar, typically in the presence of hydrogen and a nickel catalyst as disclosed in the art. Non-limiting examples of such materials include: N-(3-methoxypropyl) glucamine; N-(2-methoxyethyl) glucamine; and the like.

Catalyst - The preferred catalysts for use in the glyceride process are the alkali metal salts of polyhydroxy alcohols having at least two hydroxyl groups. The sodium (preferred), potassium or lithium salts may be used. The alkali metal salts of monohydric alcohols (e.g., sodium methoxide, sodium ethoxide, etc.) could be used, but are not preferred because of the formation of malodorous short-chain methyl esters, and the like. Rather, it has been found to be advantageous to use the alkali metal salts of polyhydroxy alcohols to avoid such problems. Typical, non-limiting examples of such catalysts include sodium glycolate, sodium glycerate and propylene glycolates such as sodium propyleneglycolate (both 1,3- and 1,2-glycolates can be used; the 1,2-isomer is preferred), and 2-methyl-1,3-propyleneglycolate. Sodium salts of NEODOL-type ethoxylated alcohols can also be used.

Reaction Medium - The glyceride process is preferably not conducted in the presence of a monohydric alcohol solvent such as methanol, because malodorous acid esters may form. However, it is preferred to conduct the reaction in the presence of a material such as an alkoxylated alcohol or alkoxylated alkyl phenol of the surfactant type which acts as a phase transfer agent to provide a substantially homogeneous reaction mixture of the polyhydroxy amine and oil (triglyceride) reactants. Typical examples of such materials include: NEODOL 10-8, NEODOL 23-3, NEODOL 25-12 AND NEODOL 11-9. Pre-formed quantities of the N-alkoxy and N-aryloxy polyhydroxy fatty acid amides, themselves, can also be used for this purpose. In a typical mode, the reaction medium will comprise from about 10% to about 25% by weight of the total reactants.

Reaction Conditions - The glyceride process is preferably conducted in the melt. N-substituted polyhydroxy amine, the phase transfer agent (preferred NEODOL) and any desired glyceride oil are co-melted at 120° C.–140° C. under vacuum for about 30 minutes. The catalyst (preferably, sodium propylene glycolate) at about 5 mole % relative to the polyhydroxy amine is added to the reaction mixture. The reaction quickly becomes homogeneous. The reaction mixture is immediately cooled to about 85° C. At this point, the reaction is nearly complete. The reaction mixture is held under vacuum for an additional hour and is substantially complete at this point.

In an alternate mode, the NEODOL, oil, catalyst and polyhydroxy amine are mixed at room temperature. The mixture is heated to 85° C.–90° C., under vacuum. The reaction becomes clear (homogeneous) in about 75 minutes. The reaction mixture is maintained at about 90° C., under vacuum, for an additional two hours. At this point the reaction is complete.

In the glyceride process, the mole ratio of triglyceride oil:polyhydroxy amine is typically in the range of about 1:2 to 1:3.1.

Product Work-Up: The product of the glyceride process will contain the polyhydroxy fatty acid amide surfactant and glycerol. The glycerol may be removed by distillation, if desired. If desired, the water solubility of the solid polyhydroxy fatty acid amide surfactants can be enhanced by quick cooling from a melt, as noted above.

Soaps and Surfactants - The compositions herein will contain various anionic, nonionic, zwitterionic, etc. surfactants. Such adjunct surfactants are preferably present at levels of up to 99%, preferably from about 30% to about 97% of the compositions.

Nonlimiting examples of such surfactants useful herein include the conventional water-soluble $C_{10}$–$C_{20}$ fatty acid salts (i.e., "soaps"), the conventional $C_{11}$–$C_{18}$ alkyl benzene sulfonates and primary, branched-chain and random $C_{10}$–$C_{20}$ alkyl sulfates, the $C_{10}$–$C_{18}$ secondary (2,3) alkyl sulfates of the formula $CH_3(CH_2)_{x(CHOSO3}^{-}M^{+})CH_3$ and $CH_3(CH_2)_y(CHOSO_3^{-}M^{+})CH_2CH_3$ where x and (y+1) are integers of at least about 7, preferably at least about 9, and M is a water-solubilizing cation, especially sodium, the $C_{10}$–$C_{18}$ alkyl alkoxy sulfates (especially EO 1–5 ethoxy sulfates), $C_{10}$–$C_{18}$ alkyl alkoxy carboxylates (especially the EO 1–5 ethoxycarboxylates), the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

Adjunct Ingredients

The compositions herein can optionally include one or more other detergent adjunct materials or other materials for assisting or enhancing cleaning performance, treatment of the substrate to be cleaned, or to modify the aesthetics of the bar composition (e.g., perfumes, colorants, dyes, etc.). The following are illustrative, but nonlimiting, examples of such adjunct materials.

Builders - Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Laundry bar formulations typically comprise from about 10% to about 80%, more typically from about 15% to about 50% by weight, of the detergent builder. Lower or higher levels of builder, however, are not meant to be excluded. Toilet bars typically contain little or no builder, but this is optional with the formulator.

Inorganic detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_{2_2}O$ in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_2$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate.

Examples of carbonate builders are the alkaline earth and alkali metal carbonates as disclosed in German Patent Application No. 2,321,001 published on Nov. 15, 1973.

Aluminosilicate builders useful in the present invention include those having the empirical formula:

$$M_z(zAlO_2ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_y(SiO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for detergent formulations due to their availability from renewable resources and their biodegradability. Citrates can also be used in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. 3,308,067, Diehl, issued Mar. 7, 1967. See also Diehl U.S. Pat. No. 3,723,322.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Enzymes - Enzymes can be included in the laundry bars herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1%, by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, a-amylases described in British Patent Specification No. 1,296,839 (Novo), RAPIDASE, International Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* vat. lipolyticum NRRLB 3673, commercially available from Toyo Jozo Co., Tagata, Japan: and further *Chromobacter viscosum* lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al 0. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 4,261,868, issued Apr. 14, 1981 to Horn, et al, U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. Nos. 4,261,868, 3,600,3 19, and 3,519,570.

Enzyme Stabilizers - The enzymes employed herein are preferably stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706, cited above. Typical detergents will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In bar compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleaching Compounds - Bleaching Agents and Bleach Activators - The laundry bar compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

One category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. 4,634,551 for other typical bleaches and activators useful herein.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonated zinc phthalocyanine.

Polymeric Soil Release Agent - Any polymeric soil release agent known to those skilled in the art can optionally be employed in the laundry compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly(vinyl ester) segments, preferably poly(vinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_4$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of suitable soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another suitable polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink.

Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Other polymeric soil release agents also include the soil release agents of U.S. Pat. No. 4,877,896, issued Oct. 31, 1989 to Maldonado et al, which discloses anionic, especially sulfoaroyl, end-capped terephthalate esters.

If utilized, soil release agents will generally comprise from about 0.01% to about 10.0%, by weight, of the detergent compositions herein, typically from about 0. 1% to about 5%, preferably from about 0.2% to about 3.0%.

Chelating Agents - The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates) as DEQUEST. Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents - The compositions of the present invention can also optionally contain water-soluble ethoxylated amines having clay soil removal and anti-redeposition properties. Detergent compositions which contain these compounds typically contain from about 0.01% to about 10.0% by weight of the water-soluble ethoxylated amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal/antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents - Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982.

Another polymeric material which can be included is polyethylene glycol (PEG). PEG can exhibit dispersing agent performance as well as act as a clay soil removal/antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders.

Brightener - Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Artic White CWD, available from Hilton-Davis, located in Italy; the 2-(4-styryl-phenyl)-2H-naphthol[1,2 -d]triazoles; 4,4'-bis- (1,2,3-triazol-2-yl)-stilbenes; 4,4'-bis(styryl)bisphenyls; and the aminocoumarins. Specific examples of these brighteners include 4-methyl-7-diethyl-amino coumarin; 1,2-bis(-benzimidazol-2-yl)-ethylene; 1,3 -diphenylphrazolines; 2,5-bis(benzoxazol-2-yl)thiophene; 2-styrylnaphth-[1,2-d] oxazole; and 2-(stilbene-4-yl)-2H-naphtho-[1,2-d]triazole. See also U.S. Pat. No. 3,646,015, issued Feb. 29, 1972 to Hamilton.

Suds Suppressors - Compounds for reducing or suppressing the formation of suds can be incorporated into the compositions of the present invention.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). These include, for example: high molecular weight hydrocarbons such as paraffin, fatty acid esters (e.g., fatty acid triglycerides), silicones, secondary alcohols, fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g. K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about –40° C. and about 5° C., and a minimum boiling point not less than about 110° C. (atmospheric pressure). It is also known to utilize waxy hydrocarbons, preferably having a melting point below about 100° C.

A preferred category of suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethyisiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

Suds suppressors, when utilized, are preferably present in a "suds suppressing amount." By "suds suppressing amount" is meant that the formulator of the composition can select an amount of this suds controlling agent that will sufficiently control the suds to result in whatever diminished level of suds may be desired. The compositions herein will generally comprise from 0% to about 5% of suds suppressor. Silicone suds suppressors are typically utilized in amounts up to about 2.0%, by weight, of the detergent composition, although higher amounts may be used. This upper limit is practical in nature, due primarly to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions In addition to the foregoing ingredients, the compositions herein can also be used with a variety of other adjunct ingredients which provide still other benefits in various compositions within the scope of this invention. The following illustrates a variety of such adjunct ingredients, but is not intended to be limiting therein.

Fabric Softeners - Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners, as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients - A wide variety of other ingredients useful in detergent compositions can be included in the compositions herein, including other active ingredients, carriers, hydrotropes, processing aids, dyes or pigments, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble salts such as $MgCl_2$, $MgSO_4$, $CaCl_2$, and the like, can be added at levels of, typically, 0.1%–2%, to provide additional sudsing and to enhance greasy cleaning.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol EO(7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

The bar compositions herein will preferably be formulated such that, during use in aqueous cleaning operations, the wash water will have a pH of between about 6.5 and about 11, preferably between about 7.5 and about 10.5. Dishwashing or personal cleansing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

The following illustrates the use of the above-described surfactants to prepare bar compositions using conventional extrusion processes. These examples are not intended to be limiting, since a wide variety of surfactants, perfumes and optional other ingredients well-known to bar formulators can optionally be used in such compositions, all at conventional usage levels.

EXAMPLE VIII

| Ingredient | Percent (wt.) |
|---|---|
| Fatty acid soap* | 83.75 |
| Glucamide surfactant** | 3.00 |
| NaCl | 0.44 |
| Minors (perfumes, etc.) | 2.5 |
| Water | Balance |
| pH | 10.25 |

*Sodium salts of mixed tallow/stearic/coconut fatty acids at a weight ratio of 70/10/20.
**$C_{12}$-N-(3-methoxypropyl)glucamide prepared in the manner of Example IV.

EXAMPLE IX

The bar of Example VIII is modified by reducing the soap level to 76% and increasing the glucamide surfactant level to 10%. A softer bar is thereby secured.

EXAMPLE X

The bar of Example VIII is modified by increasing the soap level to 85% and decreasing the glucamide surfactant level to 2%. A harder bar is thereby secured.

EXAMPLE XI

The bar of Example VIII is modified by replacing the N-alkoxy glucamide of Example IV by an equivalent amount of the mixed palm methoxypropylglucamide of Example VII.

EXAMPLE XII

A laundry bar suitable for hand-washing soiled fabrics is prepared by standard extrusion processes and comprises the following:

| Ingredient | % (wt.) |
|---|---|
| $C_{12-16}$ alkyl sulfate, Na | 20 |
| Palm N-(3-methoxypropyl)glucamide* | 5 |

-continued

| Ingredient | % (wt.) |
|---|---|
| $C_{11-13}$ alkyl benzene sulfonate, Na | 10 |
| Sodium tripolyphosphate | 7 |
| Sodium pyrophosphate | 7 |
| Sodium carbonate | 25 |
| Zeolite A (0.1–10 m) | 5 |
| Coconut monoethanolamide | 2 |
| Carboxymethylcellulose | 0.2 |
| Polyacrylate (m.w. 1400) | 0.2 |
| Brightener, perfume | 0.2 |
| Protease | 0.3 |
| $CaSO_4$ | 1 |
| $MgSO_4$ | 1 |
| Water | 4 |
| Filler** | --- Balance --- |

*Prepared from mixed palm fraction fatty acids.
**Can be selected from convenient materials such as $CaCO_3$, talc, clay, silicates, and the like.

EXAMPLE XIII

The laundry bar of Example XII is modified by the incorporation of 8% sodium perborate monohydrate or sodium percarbonate (300–600 micron) and 1% nonanoyloxybenzene sulfonate therein to provide a bleaching function.

What is claimed is:

1. A laundry or toilet bar, or the like, comprising one or more surface-active agents selected from the group consisting of synthetic anionic surfactants and soaps, said bars containing at least about 1% by weight of an alkoxy or aryloxy polyhydroxy fatty acid amide of the formula $$R-\overset{\overset{\displaystyle O}{\|}}{C}-\overset{\overset{\displaystyle R^1-O-R^2}{|}}{N}-Z$$

wherein R is a $C_7$ to $C_{21}$ hydrocarbyl moiety, $R^1$ is a $C_2$ to $C_8$ hydrocarbyl moiety moiety, $R^2$ is a $C_1$–$C_8$ hydrocarbyl moiety or oxy-hydrocarbyl moiety and Z is a polyhydroxy hydrocarbyl moiety having a linear chain with at least 2 hydroxyls directly connected to the chain, or an alkoxylated derivative thereof.

2. A bar according to claim 1 wherein R is $C_9$–$C_{17}$ hydrocarbyl, $R^1$ is $C_2$–$C_4$ alkylene and $R^2$ is $C_1$–$C_4$ alkyl.

3. A bar according to claim 1 wherein R is $C_9$–$C_{17}$ hydrocarbyl, $R^1$ is —$CH_2CH_2$— or —$CH_2CH_2CH_2$— and $R^2$ is methyl.

4. A bar according to claim 3 wherein the surface-active agent is a $C_{10}$–$C_{18}$ fatty acid soap.

5. A bar according to claim 4 which contains at least about 3% by weight of said alkoxy polyhydroxy fatty acid amide.

6. A bar according to claim 3 wherein the surface-active agent is a $C_{10}$–$C_{18}$ sulfated or sulfonated anionic surfactant.

7. A bar according to claim 6 which contains at least about 3% by weight of said alkoxy polyhydroxy fatty acid amide.

* * * * *